US005620407A

United States Patent [19]

Chang

[11] Patent Number: 5,620,407

[45] Date of Patent: Apr. 15, 1997

[54] ACTIVE CONTROL CONTAINMENT SYSTEM FOR LIMITING OCCUPATIONAL EXPOSURE TO BIOHAZARDOUS MATERIALS

[76] Inventor: Elise S. Chang, 356 Golfview Rd., N. Palm Beach, Fla. 33408

[21] Appl. No.: 489,226

[22] Filed: Jun. 12, 1995

[51] Int. Cl.[6] ..... A61G 10/00

[52] U.S. Cl. ..... 600/21; 128/897

[58] Field of Search ..... 600/21–22; 128/897; 27/21.1, 23.1

[56] References Cited

U.S. PATENT DOCUMENTS

| | | | |
|---|---|---|---|
| 1,642,577 | 9/1927 | Carson . | |
| 2,576,008 | 11/1951 | Gladfelter et al. . | |
| 3,267,830 | 8/1966 | Van Gaasbeek . | |
| 4,063,495 | 12/1977 | Duvlis | 600/21 |
| 4,561,903 | 12/1985 | Blaul | 134/10 |
| 4,566,293 | 1/1986 | Arner et al. | 62/514 R |
| 4,650,171 | 3/1987 | Howorth | 269/322 |
| 4,666,478 | 5/1987 | Boissinot et al. | 55/279 |
| 4,876,773 | 10/1989 | Wade | 27/23.1 |
| 5,262,578 | 11/1993 | Hall | 588/249 |
| 5,342,121 | 8/1994 | Koria | 312/1 |
| 5,453,077 | 9/1995 | Donnelly et al. | 600/22 |

FOREIGN PATENT DOCUMENTS

| | | | |
|---|---|---|---|
| 3602448 | 7/1987 | Germany | 600/21 |
| 8804917 | 7/1988 | WIPO | 600/21 |

OTHER PUBLICATIONS

Germ Free Laboratories, "Controlled Environment Animal Care", Oct. 7, 1965.

*Primary Examiner*—Angela D. Sykes
*Assistant Examiner*—John P. Lacyk
*Attorney, Agent, or Firm*—Grace J. Fishel

[57] ABSTRACT

An active control containment system for defending an operator against biohazardous materials for use in medical, forensic and embalming procedures. The containment system has the advantage of being structurally simple, light weight and easily cleaned and maintained. The containment system includes a vaulted cover which together with an autopsy table forms a compartment within which the biohazardous material is contained. The autopsy table has a plurality of apertures through which a down-draft keeps the compartment at negative pressure as compared to the treatment room. An air intake is provided in the cover and an opening through which the operator can access the biohazardous material through the cover. Access doors are provided along the bottom of the cover for manipulation or transfer of materials.

7 Claims, 2 Drawing Sheets

ACTIVE CONTROL CONTAINMENT SYSTEM FOR LIMITING OCCUPATIONAL EXPOSURE TO BIOHAZARDOUS MATERIALS

BACKGROUND OF THE INVENTION

1. Field of the Invention

The present invention relates to an active control containment system for enclosure of biohazardous materials for use in medical, forensic and embalming procedures. The containment system is distinct from existing passive control measures consisting of personal protective equipment. The containment system can be used on biohazardous materials of human or animal origin which are living or dead at the time of examination.

2. Brief Description of the Prior Art

Autopsy tables used in hospitals typically have a downdrain system consisting of a discontinuous or perforated surface and an internal down-draft ventilation system for collecting blood and body fluids and drawing air-borne bacteria and aerosolized particles away from the operator. Even with the best of systems, however, some resistant, air-borne bacteria and aerosolized particles escape into the autopsy room, some of which will pass through an ordinary surgical mask. A hospital autopsy room also typically has a positive-pressure type ventilation system with air entering the room from the ceiling and leaving though vents in the walls, near floor level. With this form of ventilation, the air moves downwards past the operator at the table. This not only reduces smell but also helps to sweep away any infective vapors or particles. Sometimes the conditioned air is supplied from an overhead canopy. This arrangement increases the air flow past the operator but may cause undesirable turbulence around the operator's face which may increase (rather than decrease) the chance that the operator will inhale dangerous bacteria or aerosolized particles during performance of an autopsy.

Steps are also taken to protect the operator against being splashed with blood or other body fluids in compliance with the Centers for Disease Control (CDC) "Universal Precautions". Typical wear includes a lightweight shirt and trousers, such as those used by surgeons, an operating gown, waterproof apron, surgical cap and surgical or examining gloves. Non-slip, full length rubber boots are recommended together with protective goggles as acquisition of infection through the eye is possible because of the vulnerable nature of its membranes.

There are frequently spectators at an autopsy such as other doctors, medical students, law enforcement officers, prosecutors, etc. Because blood and other body fluids may be splashed on the floor and because of the aerosolized fluids and particles coming from the corpse, the spectators should be gowned, masked, booted and gloved also, all of which adds to the cost of conducting an autopsy. On the other hand, if they are improperly outfitted and are allowed unauthorized entry into the room wearing their everyday shoes, for example, they may carry blood and infected material out with them.

In general, the equipment used by morticians is not as sophisticated as that used in autopsies, increasing the likelihood that funeral workers will be exposed to biohazardous materials in the performance of their duties. For example, tables used by most morticians have no air exhaust system and there is often no plumbing assembly for collecting blood and body fluids or for disposing of embalming fluids. The majority of embalming fluids contain 10% formalin as formaldehyde, paraformaldehyde (a formaldehyde polymer), or trioxane (another formaldehyde polymer). Formaldehyde is associated with cancers of the lung, nasal and oral cavities. It is highly irritating to the upper respiratory tract and eyes and is a severe skin irritant and sensitizer. Deaths from accidental exposure to high concentrations of formaldehyde have been reported and there is an Occupational Safety and Health Administration (OSHA) standard limiting employee exposure.

To appreciate the extent of a mortician's exposure to formaldehyde, it is necessary to know something about the embalming process. When a body is embalmed, embalming fluid is injected under pressure into the arterial system, and blood is drained from the venous system, sometimes simultaneously and sometimes intermittently. The blood drains as it is carried through the vascular system by the pressure of the injected embalming fluid and by gravity. When done properly, injected fluid will also enter the lymphatic system and ultimately drain into the venous system, the goal being to have the embalming fluid permeate the tissues in order to preserve them. Since the injected embalming fluid follows the path of least resistance, some tissues may not be perfused, resulting in varying degrees of preservation. Techniques such as massage, manipulation of the body parts (lowering the arms, for example), and restriction of drainage are used to avoid such problems.

The number and location of injection sites in non-autopsied bodies depend on the funeral director's technique and the success of initial attempts at arterial injection. Sometimes the entire body can be embalmed through one arterial access site, but often more than one is required. The general approach is for the funeral director to select a primary injection site, perform arterial injection, assess the adequacy of perfusion, and then use secondary sites as needed to ensure perfusion of all body regions. In single-point injection, an artery and vein at one location are used for injection and drainage, respectively. Split injection utilizes an artery at one side and a vein at another side. In restricted cervical injection, both common carotid arteries are used and fluid is injected to the head through both arteries and to the remaining portions of the body through a tube directed downward in the right common carotid artery, with drainage being taken from the right jugular vein. Sectional injection uses a primary site and selected additional sites such as the brachial or radial artery in the arms. Six-point injection utilizes both common carotids, both axillary or brachial arteries in the arms, and both femoral or external iliac arteries in the groin.

After arterial embalming and depending on the mortician's practice, the cadaver is eviscerated through a midline incision and all the internal organs removed and discarded separately. The internal cavity is stuffed with absorbent material and sewed closed. Alternatively, the internal organs may be left in place and a trocar may be used to aspirate liquefied material from the viscera and body cavities. When aspiration is complete, a quart or more of concentrated embalming fluid may be injected through the trocar.

When an autopsy has been performed on the body, other procedures come into play, requiring additional handling of the body by the mortician. For example, when the brain has been removed and there is a freely removable skullcap, embalming of the face requires cannulation of the carotid artery at the side of the neck with clamping of the middle cerebral artery within the inner side of the skull. Embalming fluid will spill onto the table from the cut middle cerebral vein while the face is massaged. When the abdominal cavity is already emptied of internal organs, the abdominal wall and legs can be embalmed by cannulation of the common iliac arteries within the groin while the abdominal wall and legs are massaged. Embalming fluid will spill into the abdominal cavity, from which it is removed with a pump or ladle.

Unlike autopsy rooms, most embalming rooms used by morticians have no positive-pressure type ventilation system. A fan or a standard office air-conditioner merely recirculates the formaldehyde, air-borne bacteria and aerosolized particles within the closed room, possibly recirculating contaminants to adjacent rooms. Funeral home workers, particularly those handling human remains, are therefore at risk of infection and exposure to formaldehyde, OSHA standards (described below) frequently not being met. Some morticians also have the false perception that whatever organisms that caused mortality in the cadaver will become nonviable when their host is dead and fail to observe "Universal Precautions" (described below) regarding protective clothing, etc., further increasing the risk of infection.

SUMMARY OF THE INVENTION

In view of the above, it is an object of the present invention to provide an active control containment system that not only supplements the personal protection and ventilation systems already available to persons performing necropsies or providing mortician services but also protects the air space shared by the autopsy or embalming room and adjacent rooms. It is another object to provide an active control containment system that facilitates better compliance with the "Universal Precautions" and OSHA regulations. It is a further object to provide an active control containment system that, in most circumstances, may be sufficiently effective to obviate the need for spectators to be gowned, booted, etc. and wear respirators. Other objects and features of the invention will be in part apparent and in part pointed out hereinafter.

In accordance with the invention, an active control containment system for biohazardous materials for use in medical, forensic and embalming procedures, defends an operator from being splashed by or inhaling biohazardous materials. The containment system includes an autopsy table and a vaulted cover. The autopsy table has an internal air chamber and an upper surface defining a body supporting top. The top has a plurality of apertures that are in fluid communication with the air chamber and an exhaust duct evacuates air from the air chamber and establishes a down-draft through the apertures in the surface.

The vaulted cover is made of material impermeable to the biohazardous materials to be contained. The cover is at least in part formed of transparent material and is open on the bottom. When the bottom is placed proximate the supporting top, the bottom forms an air seal, at least in part, with the supporting top and with the supporting top defines a substantially closed compartment for containing the biohazardous materials. An air intake aperture is provided in the cover for providing air flow through the compartment, with the compartment maintained at a negative pressure compared to the treatment room by the down-draft through the apertures in the surface. A plurality of openings (preferably eight) are provided in the cover through which an operator can work with the biohazardous materials in the compartment.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
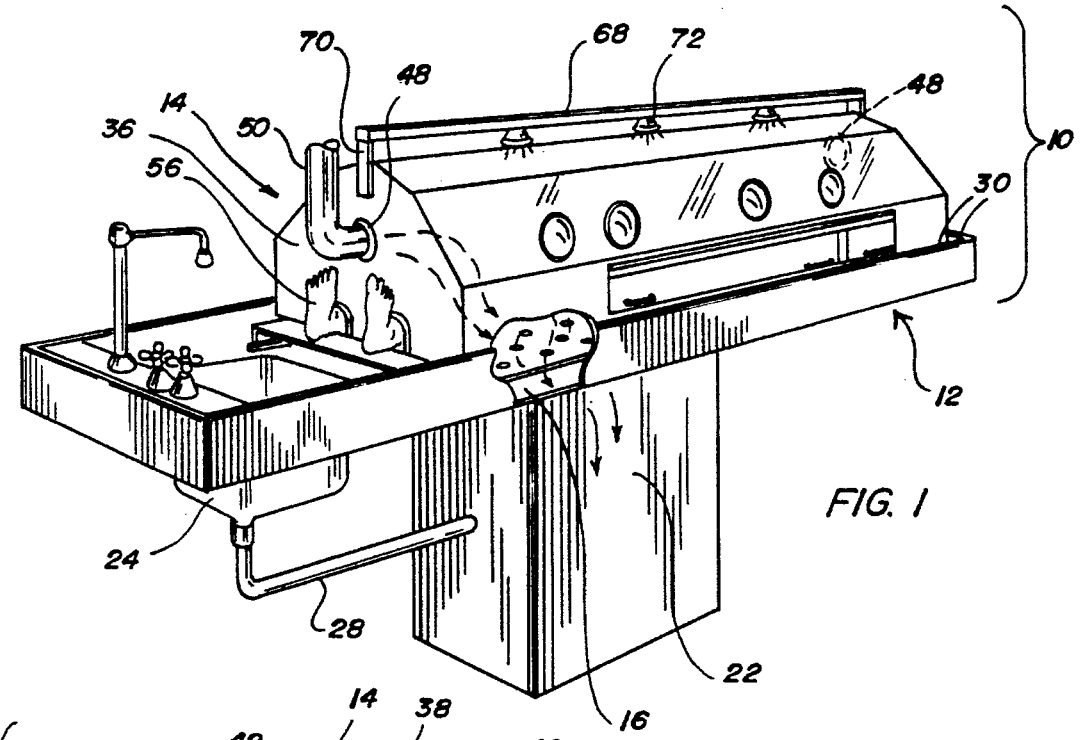
FIG. 1 is an active control containment system for limiting exposure to biohazardous materials in accordance with the present invention, including a vaulted cover attached to a positive-pressure type ventilation system and a ventilated autopsy table with an internal down-draft system.

Referring to the drawings more particularly by reference character, reference numeral 10 identifies an active control containment system for limiting occupational exposure to biohazardous materials in accordance with the present invention for use in medical, forensic and embalming procedures. Containment system 10 is designed to facilitate better compliance with the "Universal Precautions" and with OSHA standards, both of which are focused primarily on personal protective equipment.

The "Universal Precautions" were published by the CDC to establish guidelines for the protection of persons performing necropsies or providing mortician services. The principle behind the "Universal Precautions" is to consider all blood and body fluids from all cadavers as potentially infectious and use appropriate barriers (personal protective equipment) to prevent exposure. The four Golden Rules of the "Universal Precautions" are as follows:

1. Gloves must be worn by all staff when in contact with body substances, mucous membranes or tissues. Body substances include blood, pus, urine, feces, sputum, saliva, bile, spinal fluid and all other body fluids. Gloves are required for all vascular access procedures, invasive procedures, etc.
2. A gown must be worn when splattering of body substances is likely. Gowns must also be worn when contamination of skin and/or clothing is anticipated.
3. Masks and/or goggles must be worn if aerosolization or splattering of body substances is likely.
4. Hands must be thoroughly washed immediately if contaminated with blood or body fluids and before and after all cadaver contacts.

The main emphasis of the OSHA requirements regulating occupational exposure (i.e., inhalation and skin contact) to aerosolized and blood-borne pathogens is on personal protection. Existent equipment including gloves, gowns, waterproof aprons, caps, goggles, boots and masks are effective against splashes but provide limited protection against aerosolized blood and other airborne pathogens. OSHA also regulates occupational exposure to formaldehyde by setting short term exposure limits (STEL) and permissible exposure limits (PEL) and by demanding proper disposal and decontamination of formaldehyde-contaminated clothing (29 CFR Section 1910.1048). According to OSHA regulations, the employer must ensure that no employee is exposed to an airborne concentration of formaldehyde in excess of 2 ppm in a 15-minute period (STEL) or in excess of 0.75 ppm in an 8-hour period (PEL).

For spills of formaldehyde having a concentration greater than 1%, of ½ liter or more, when room air concentrations are likely to exceed PEL/STEL, OSHA requires that all individuals exposed be equipped with self-contained breathing apparatus, personal protective equipment (including non-vented goggles and splash shields) and chemical protective clothing (including specific brand clothing impervious to formaldehyde, gloves impervious to formaldehyde and a full-facepiece air-purifying respirator). As will be evident from the Brief Description of the Prior Art, spills of this kind occur, quite frequently, during embalming procedures and funeral workers, not infrequently, are exposed to formaldehyde in excess of PEL/STEL.

The "Universal Precautions" and OSHA regulations are generally followed by pathologists and their technicians during medical and forensic autopsies. Even so, these operators are also subject to exposure to air-borne pathogens that pass through a surgical mask. The "Universal Precautions" and OSHA regulations are much less frequently followed by morticians. Full compliance is also not always achieved with spectators at medical and forensic autopsies.

As shown in FIG. 1, active control containment system 10 includes an autopsy table 12 and a vaulted cover 14. Autopsy table 12 is of the kind having an internal air chamber 16 and an upper surface defining a body supporting top 18. Upper surface 18 has a plurality of apertures 20 (e.g., discontinuities or perforations) though which fluid communication is established with internal air chamber 16. An exhaust duct 22 with a fan (not shown) evacuates air from air chamber 16, establishing a down-draft through apertures 20 in supporting top 18.

With continuing reference to FIG. 1, autopsy table 12 is rectangular and about two and one-half feet wide and about eight to nine feet long. Supporting top 18 slopes towards one end, draining into a sink 24. Any blood or other body fluids released by a body 26 during examination, together with any irrigating fluids, will flow into the sink and thus into a drain 28, where it is pretreated and ultimately drained into a sewer. A raised rim 30, preferably rounded so that body 26 can be easily slid onto the table, is provided around the edges of the table and serves to confine blood and other body fluids thereon.

A vaulted cover 14 is made of material impermeable to biohazardous materials (e.g., human or animal body, living or dead at the time of examination, or part thereof, illustrated as cadaver 26) to be contained. At least a portion and preferably all of cover 14 is made of a transparent material. Suitable materials presently available for cover 14 include Acrylite® polyacrylic resin and Lexan®, polycarbonate resin among which Acrylite resin is preferred because it is both economical and strong, Lexan resin being more expensive. It will be understood that the material for cover 14 is not limited to Acrylite resin and Lexan resin, those materials being mentioned because they are commercially available, impermeable to the biohazardous materials to be contained and clear, other materials with those properties also being acceptable.

Cover 14 has an open bottom 32 and side and end walls 34, 36, respectively, and a closed top 38. Side and end walls 34, 36 meet at right angular corners, following the contour of autopsy table 12 at bottom 32 to form an air seal at least in part when bottom 32 is placed proximate (or upon) supporting top 18. Sidewalls 34 preferably fit just inside rim 30 along the side edges of the table. Cover 14 and supporting top 18 define a substantially closed compartment 40 for containing the biohazardous materials. In the form illustrated, side and end walls 34, 36 are generally vertical and top 38 has a ridge 42 at the center with a lower section 44 that is longer and steeper sloped in the direction of the ridge and an upper section 46 that is shorter and lower sloped. In this preferred form, the seams between sidewalls 34 and upper and lower sections 46, 44 are located out of the operator's line of sight and lower section 44 provides a flat surface through which the operator can view the biohazardous materials to be worked upon. End walls 36 conform to a vertical section taken through top 38 and sidewalls 34.

An air intake 48 is provided in cover 14 for promoting a purging flow of air through compartment 40, said compartment being maintained at a negative pressure compared to the treatment room by the down-draft through apertures 20 in supporting top 18 under the cover. Air intake 48 is an open port, particularly when the treatment room is maintained at a positive pressure, as is the case in an autopsy room. For airflow purposes, however, it may be preferred to connect air intake 48 to a ventilation source 50 outside the treatment room, supplying air at a positive pressure compared to the treatment room for better purging of the compartment. As illustrated in the drawings, air intake 48 is provided in end wall 36 on the leg side. Air intake 48 is shown passing though section 36 on the leg side, preferably above eye level of the operator.

Figure 5:
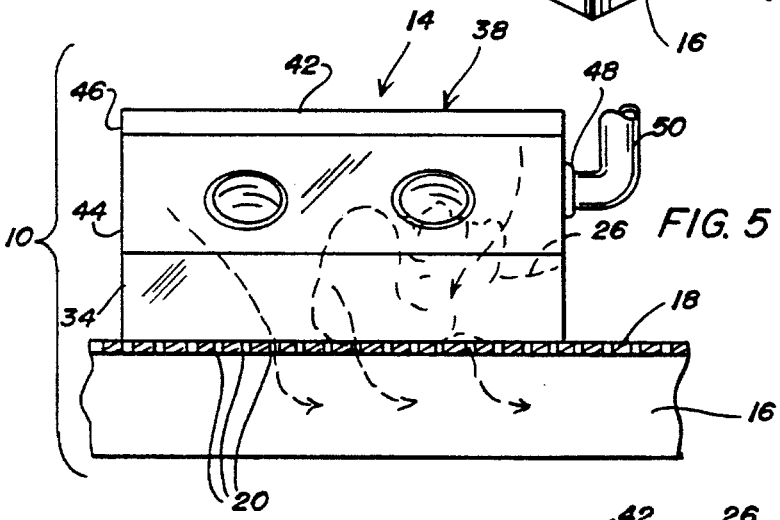
Fig. 5 is a side elevation, partly in section, of an active control containment system for use in medical, forensic and embalming procedures involving only the head; and, Fig. 6 is a side elevation, partly in section, of an active control containment system for use involving the head, thorax and abdomen.
Figure 6:
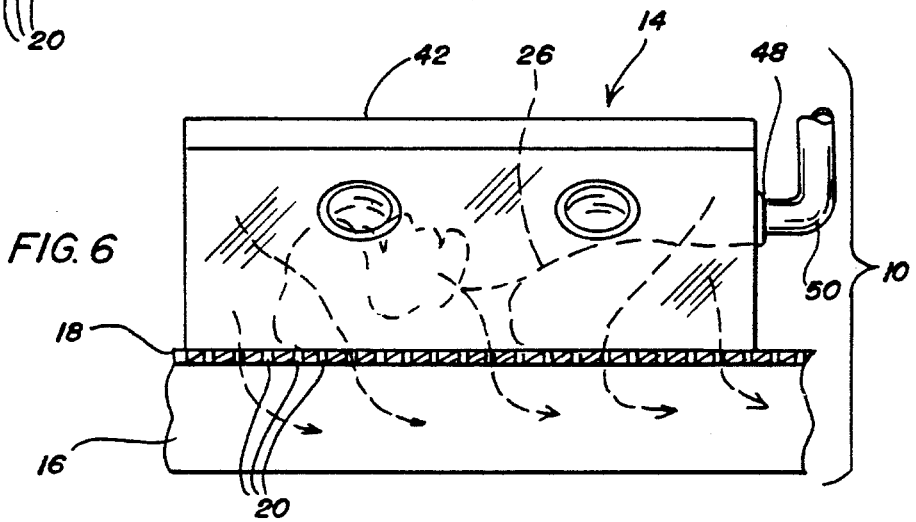

One or more openings 52 are provided in cover 14 to allow the operator access to compartment 40 for working with the biohazardous materials. The number and precise location of openings 52 depend upon the length of cover 14. For example, as shown in FIGS. 1–4, where cover 14 has a length such that it covers the entire cadaver, except possibly feet 56, two pairs of openings 52 are provided in lower section 44 of top 38. One pair is located adjacent the head area of the corpse and a second, more widely spaced pair, is located near the groin area. In FIG. 5, cover 14 is designed to envelope just the head of the cadaver and in FIG. 6, the head, thorax and abdomen, in which case only one pair of openings 52 are required. Other units for covering less than all of the corpse (e.g., trunk unit, leg unit, etc.) may be readily designed and appropriately outfitted. It is preferred that an opposing set of openings 52 be provided on each side of cover 14 so that the biohazardous materials in compartment 40 may be addressed from either side.

Figure 3:
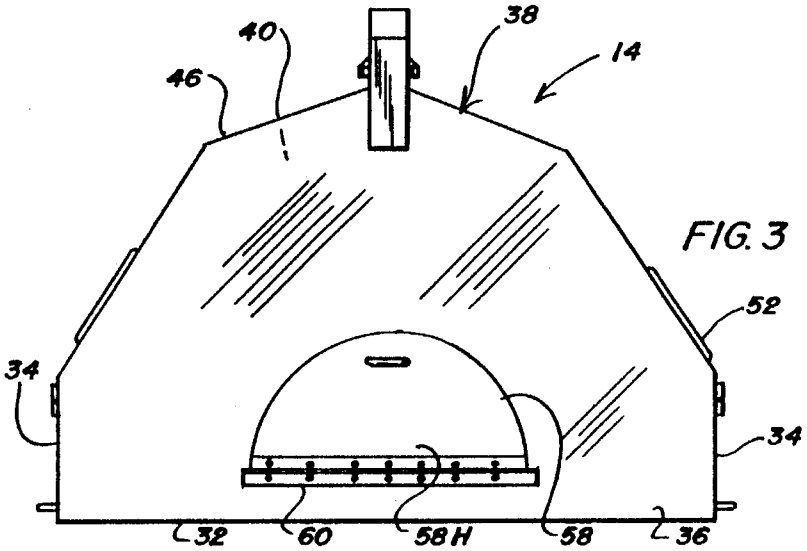
FIG. 3 is a right end view of the cover as viewed in FIGS. 1 and 2 on the head side.

One or more access doors 58 (e.g., 58H, 58G and 58T, described below) are provided in cover 14 such that surgical tools and materials needed for medical, forensic or embalming procedures may be passed into compartment 40 and other materials passed out. When cover 14 envelopes the head of the cadaver, a door 58H is provided in end wall 36 adjacent the head and may, as shown in FIG. 3 take the form of a semicircular door attached by straight-bolted hinges 60 for manipulation and/or transfer of material. Other access doors 58 are provided in sidewalls 34, including a door 58T for access to the thorax and, a wider door 58G for access to the groin area, when the cover has a length that it covers the entire (or substantially the entire) length of the cadaver. Doors 58T, 58G, etc. may also be attached by straight-bolted hinges 60 for manipulation and/or transfer of material and door 58G may be closed while door 58T is opened to allow manipulation of extended arms. Cutouts 62 may be provided in end walls 36 for feet 56 (see FIGS. 1 and 4) or so that end walls 36 slip over the neck of the cadaver (see FIG. 5), over the abdomen (see FIG. 6), etc.

The location of the access doors 58 as shown in the drawings satisfy the requirements of those doing medical, forensic and embalming procedures on a cadaver, taking into consideration the various procedures described above in the Brief Description of the Prior Art. For example door 58T provides access to the thorax for the purpose of injecting embalming fluids into the carotid arteries, while door 58G provides access to the groin area for injecting into the femoral or external iliac arteries. Additionally, doors 58 allow manipulation and extension of the arms.

Figure 2:
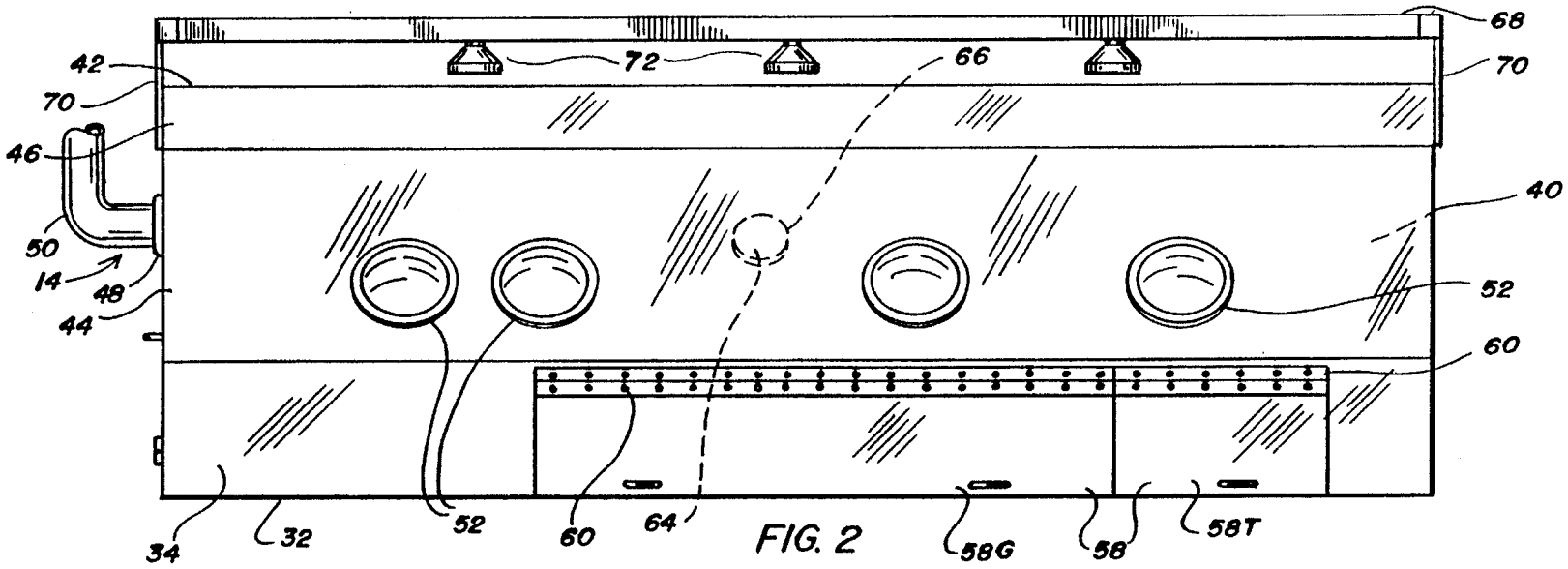
FIG. 2 is a side elevation of the cover.
Figure 4:
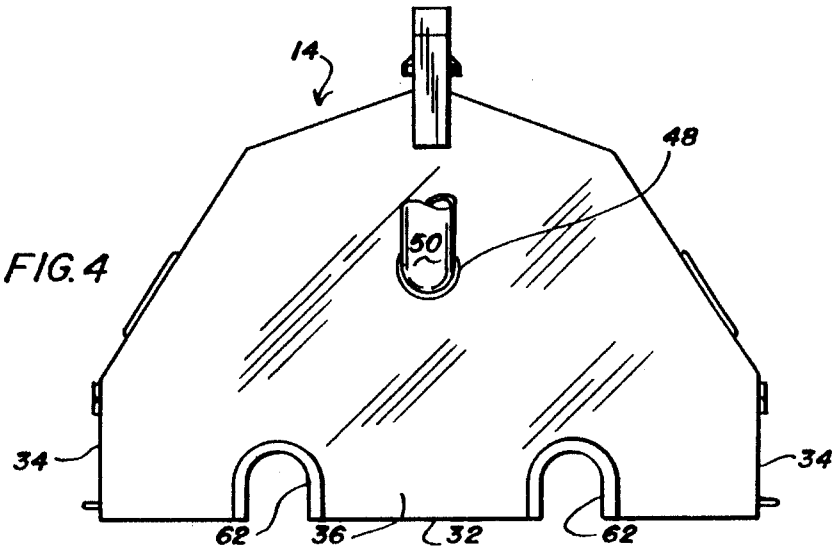
FIG. 4 is a left end view of the cover as viewed in FIGS. 1 and 2 on the foot side.

A magnifying lens 64 may be sealed in other openings 66 provided in cover 14, one of which is illustrated in FIG. 2, located midway the length of the cover, at about eye level. Lens 64 provides low level, but conveniently available magnification, whose utility will occur to those using cover 14 to examine biohazardous material in various medical, forensic and embalming procedures. A lighting track 68 (i.e., an external light source), longitudinally aligned with ridge 42 and supported on a pair of brackets 70 from end walls 36, may also be provided. Light source 68 may be provided with several spot lamps 72, which are particularly valuable for medical and forensic procedures where excellent light is needed, for example, to pick up details of wounds and the like. Light source 68 is subject to design and structure modifications, including by way of example, using nonmercury florescence light tubes.

In use, active control containment system 10 supplements the personal protection systems and ventilation systems already available to persons performing necropsies or providing mortician services. As will be readily appreciated by those skilled in the art, it facilitates better compliance with the "Universal Precautions" and OSHA regulations and, in some circumstances, may be sufficiently effective to obviate the need for spectators to wear gowns, face masks, boots, etc.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An active control containment system for biohazardous materials for use in medical, forensic and embalming procedures within a treatment room comprising:

an autopsy table having an internal air chamber and an upper surface defining a body supporting top with a table edge, said supporting top having a plurality of apertures in fluid communication with the air chamber; an exhaust duct for evacuating air from the air chamber and establishing a down-draft through the apertures in the surface;

a vaulted cover made of material impermeable to the biohazardous materials to be contained, said cover made at least in part of transparent material and open on the bottom, said bottom forming an air seal at least in part when placed proximate the supporting top, said cover and said supporting top defining a substantially closed compartment for containing the biohazardous materials, an air intake in the cover providing air flow through the compartment, said compartment maintained at a negative pressure compared to the treatment room by the down-draft through the apertures in the surface, at least one opening in the cover through which the operator can work with the biohazardous materials in the compartment and through which air is drawn from the treatment room, whereby said containment system provides active control and defends the operator from being splashed by or from inhaling the biohazardous materials in the compartment.

2. The containment system of claim 1 wherein the cover has side and end walls and a closed top, said side and end walls following the contour of the supporting top along the bottom and being secured to the table edge.

3. An active control containment system for biohazardous materials for use in medical, forensic and embalming procedures within a treatment room comprising:

a rectangular autopsy table with a raised rim around side and end edges for confining blood and other body fluids thereon, said autopsy table having an internal air chamber and an upper surface defining a body supporting top, said supporting top having a plurality of apertures in fluid communication with the air chamber; an exhaust duct for evacuating air from the air chamber and establishing a down-draft through the apertures in the surface;

a vaulted cover made of material impermeable to the biohazardous materials to be contained, said cover made of transparent material and open on the bottom, said bottom forming an air seal at least in part when placed proximate the supporting top, said cover and said supporting top defining a substantially closed compartment for containing the biohazardous materials, an air intake in the cover providing air flow through the compartment, said compartment maintained at a negative pressure compared to the treatment room by the down-draft through the apertures in the surface, at least one opening in the cover through which an operator can reach the biohazardous materials in the compartment and through which air is drawn from the treatment room, whereby said containment system provides active control and defends the operator from being splashed by or from inhaling the biohazardous materials in the compartment.

4. The containment system of claim 3 wherein the cover has side and end walls that meet at right angular corners and a closed top, said side and end walls following the contour of the supporting top along the bottom and said sidewalls fitting just inside the rim along the side edges of the autopsy table, said top further having a ridge at its center with a lower section that is longer and steeper sloped in the direction of the ridge and an upper section that is shorter and lower sloped whereby the seams between the sidewalls and the upper and lower sections are out of the operator's line of sight and the lower section provides a flat surface through which the operator can view the biohazardous materials.

5. The containment system of claim 4 wherein at least one access door is provided along at least one of the sidewalls for manipulation of arms and hands or transfer of material into the compartment.

6. The containment system of claim 4 wherein the compartment is adapted to substantially contain a cadaver, said cover having a first access door in the end wall near the head of the cadaver and a second access door in the sidewall adjacent the thorax, chest and shoulders of the cadaver and a third access door in the sidewall adjacent the groin area of the cadaver, said access doors for manipulation of arms and hands or transfer of material into the compartment.

7. The container system of claim 4 wherein an external light source is mounted on the top, said light source having at least one spot lamp.

* * * * *